US011072449B2

(12) United States Patent
Lutzow et al.

(10) Patent No.: US 11,072,449 B2
(45) Date of Patent: Jul. 27, 2021

(54) UNIVERSAL BAG SPLITTING DEVICE

(71) Applicants: Garrett Lutzow, Pewaukee, WI (US); Jacob Lutzow, New Berlin, WI (US)

(72) Inventors: Garrett Lutzow, Pewaukee, WI (US); Jacob Lutzow, New Berlin, WI (US)

( * ) Notice: Subject to any disclaimer, the term of this patent is extended or adjusted under 35 U.S.C. 154(b) by 0 days.

(21) Appl. No.: 16/408,548

(22) Filed: May 10, 2019

(65) Prior Publication Data

US 2020/0354099 A1 Nov. 12, 2020

(51) Int. Cl.
*B65B 69/00* (2006.01)

(52) U.S. Cl.
CPC ..... *B65B 69/0091* (2013.01); *B65B 69/0008* (2013.01); *B65B 69/0041* (2013.01)

(58) Field of Classification Search
CPC ..... B65B 69/0091; B65B 69/0008; B65B 69/0033; B65B 69/0041
See application file for complete search history.

(56) References Cited

U.S. PATENT DOCUMENTS 1,788,267 A * 1/1931 Paiva ..... A47B 23/02 108/49
3,724,721 A * 4/1973 Barr ..... A01C 15/006 222/83.5
4,557,825 A 12/1985 Wittes et al.
5,101,977 A 4/1992 Roman
5,267,823 A 12/1993 Roman
5,405,053 A 4/1995 Zublin
5,937,766 A * 8/1999 Denny ..... B25H 5/00 108/143
6,077,021 A 6/2000 Roman
6,241,097 B1 6/2001 Roman
7,073,264 B2 7/2006 Votolato
7,559,687 B2 7/2009 Swisher
8,864,006 B1 * 10/2014 Page ..... B26F 1/18 225/6
2005/0040296 A1 * 2/2005 Rosa ..... A47F 7/04 248/124.1
2013/0341474 A1 * 12/2013 Baines ..... A47H 1/142 248/208
2014/0339381 A1 * 11/2014 Weldon ..... A47K 3/004 248/126
2015/0361775 A1 * 12/2015 Pham ..... B01F 7/088 166/305.1
2016/0255981 A1 * 9/2016 Rae ..... A47H 1/142
2018/0027764 A1 * 2/2018 Coleman ..... A01K 5/0225

FOREIGN PATENT DOCUMENTS

GB 2246755 A * 2/1992 ..... B65B 69/0008

OTHER PUBLICATIONS

The Boss Snowplow TGS 1100 & TGS 600 Tailgate Spreader Installation & Owner's Manual, Boss Products, Iron Mountain, MI, 2012, pp. 1-31.

* cited by examiner

*Primary Examiner* — Stephen Choi
(74) *Attorney, Agent, or Firm* — Jeffrey S. Sokol

(57) ABSTRACT

A universal bag splitting device includes a rod assembly with an adjustable length, a cutting blade attached to a surface of the rod assembly, and interchangeable brackets connectable to first and second ends of the rod assembly. The interchangeable brackets are configured to maintain a position of the rod assembly when the universal bag splitting device is in use.

1 Claim, 6 Drawing Sheets

UNIVERSAL BAG SPLITTING DEVICE

BACKGROUND OF THE INVENTION

The present invention relates generally to a bag splitting device and, more particularly, to a device that efficiently splits open bags of materials in a wide array of applications.

Construction and maintenance of residential, commercial, and industrial properties requires many different kinds of materials. Frequently, these materials come in large and/or heavy bags and many bags of the materials are required to complete a specific task. For example, landscapers planting grass for a new lawn or park or fertilizing such an area will generally require many large bags of seed and/or fertilizer. Further, during a snow removal and/or de-icing process, many bags of salt or snow melt may be needed to cover a large area such as, for example, a street or a parking lot. Also, construction workers may need many bags of drywall mud/joint compound, concrete mix, mortar mix, and other materials to complete various projects such as, for example, drywalling a building or installing or fixing a concrete patio, sidewalk, curb, or street. In addition, properties with a water softener may need several bags of salt to fill the water softener's brine tank.

Often, opening bags of materials is simply performed using a hand tool such as, for example, a knife, a snips, or a scissors. Once a bag of materials is cut or split open, the materials usually need to be emptied into a container or machine such as, for example, a water softener brine tank; a five-gallon pail or bucket; a seed, fertilizer, or salt spreader; or a wheel barrow, depending on the type and purpose of the materials. When opening a small number of bags or bags that are relatively light, using a hand tool to open the bag and then emptying the bag's materials into the relevant apparatus may not be too inconvenient. However, when opening a large number of bags or even a small number of large, heavy bags, such as, for example, bags filled with salt, snow melt, seed, or fertilizer, it is cumbersome to repeatedly cut open, lift, and empty the bags.

Some machines include devices that are equipped to split open bags of materials such that the materials are emptied directly into a container on the machine or the machine itself. However, installation and use of those devices are limited to their particular machines. That is, the splitting devices are designed for a singular purpose and cannot be easily modified for use in another machine or by itself. Further, those splitting devices may not be easily removable from their respective machines and may additionally be limited in their use on their corresponding machines. In other words, the device may only be mounted on the machines in one way and cannot be adjusted.

It would therefore be desirable to provide a device that allows bags of materials to be split open in a more convenient and efficient manner and that may be modified for use in a variety of circumstances.

BRIEF DESCRIPTION OF THE INVENTION

Embodiments of the present invention provide a universal bag splitting device that is adaptable to different sizes and configurations such that it may be conveniently installed for use many different settings.

In accordance with one aspect of the invention, a universal bag splitting device includes a rod assembly with an adjustable length, a cutting blade attached to a surface of the rod assembly, and a pair of interchangeable brackets connectable to first and second ends of the rod assembly. The pair of interchangeable brackets are configured to maintain a position of the rod assembly when the universal bag splitting device is in use.

In accordance with another aspect of the invention, a universal bag splitting apparatus includes a rod assembly having a first end, a second end, a support rod, and a first primary extension rod that is adjustable with respect to the support rod at the first end of the rod assembly to modify a length of the rod assembly. The universal bag splitting apparatus also includes a cutting blade attached to the support rod of the rod assembly, a first bracket connectable to at least the first end of the rod assembly, and a second bracket connectable to at least the second end of the rod assembly. The first and second brackets are configured to sustain a position of the rod assembly in at least one configuration selected from the group of a mounted configuration, a supported configuration, and a mounted and supported configuration.

In accordance with yet another aspect of the invention, a kit for a universal bag splitting assembly includes an adjustable rod assembly. The adjustable rod assembly includes a support rod with a first end and a second end. The adjustable rod assembly also includes one or more extension rods positioned at each of the first end of the support rod and the second end of the support rod for adjusting a length of the rod assembly. Each extension rod is moveable with respect to the support rod, another extension rod of the one or more extension rods, or a combination thereof. The universal bag splitting assembly additionally includes a cutting blade attachable to a surface of the support rod between the first and second ends of the support rod and a plurality of interchangeable brackets that are attachable to the rod assembly and capable of sustaining a position of the rod assembly.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention relate to a universal bag splitting device having an adjustable rod assembly and a cutting blade extending from the rod assembly for splitting open bags of materials. A length of the bag splitting device is adjustable via the rod assembly. The bag splitting device further includes a plurality of brackets that are interchangeable at the ends of the rod assembly. The bag splitting device may be mounted and/or supported via the plurality of brackets.

Figure 1:
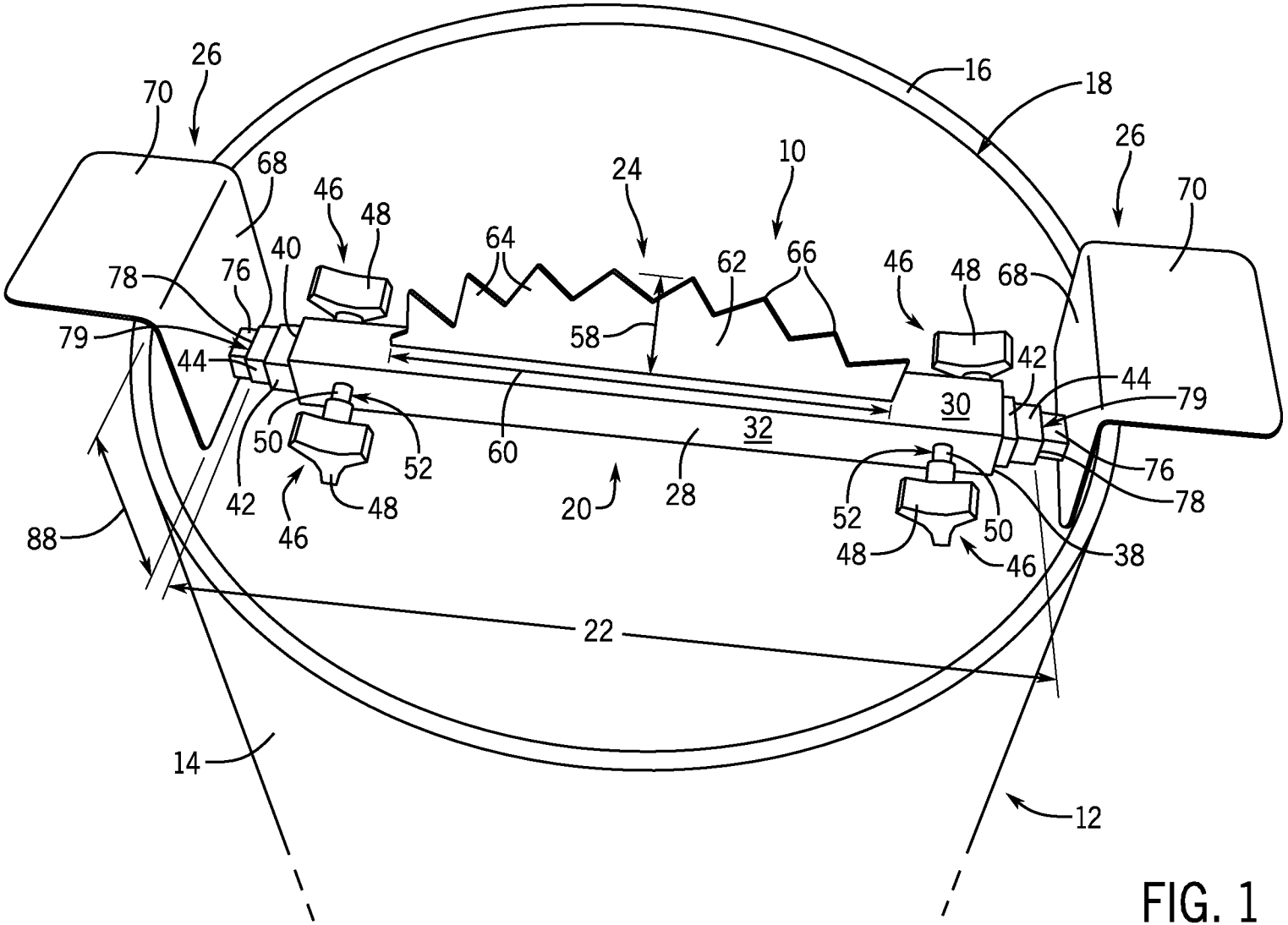
FIG. 1 is a perspective view of a universal bag splitting device supported on a container, according to an embodiment of the invention.

Referring to FIG. 1, a perspective view of a universal or adaptable bag splitting device or assembly 10 supported on a container 12 is shown, according to an embodiment of the invention. Container 12 includes a sidewall 14 having a substantially circular shape. An upper edge 16 of sidewall 14 forms an opening 18 in container 12. As a non-limiting example, container 12 may be in the form of a conventional five-gallon bucket. Bag splitting device 10 includes a rod assembly 20 having an adjustable or variable length 22, a cutting knife or blade 24 extending from rod assembly 20 for splitting open bags of materials, and support brackets 26 coupled to rod assembly 20 for maintaining or sustaining the position of bag splitting device 10 with respect to container 12. In some embodiments, bag splitting device 10 further includes a guard (not shown) that may be used to cover cutting blade 24 when it is not in use to prevent wear on or damage to cutting blade 24 and/or to prevent people from injuring themselves on cutting blade 24. Bag splitting device 10 is typically formed of metal, such as, for example, stainless steel or aluminum, but may be formed other materials, as appropriate. Preferably, but not necessarily, the material or materials used to form bag splitting device 10 are rust-proof or rust-resistant.

In FIG. 1, bag splitting device 10 is in a retracted position in which rod assembly 20 is as compact as possible. In other words, rod assembly 20 is at its shortest length 22, also referred to as its retracted length 22. Rod assembly 20 includes a central support rod 28 that is constructed with a substantially square shape with rounded corners. However, support rod 28 may be constructed with another shape, such as, for example, substantially rectangular or circular, in various embodiments. Support rod 28 includes a top surface 30, a first side surface 32, a second side surface 34 (shown in FIGS. 3 and 5), a bottom surface 36 (shown in FIG. 6), a first end 38, and a second end 40. In the embodiment of bag splitting device 10 of FIG. 1, support rod 28 is completely hollow. However, in some embodiments, support rod 28 may include additional support structure therein such as, for example, a plate or block centrally located between first and second ends 38, 40.

Rod assembly 20 further includes a primary extension rod 42 and a secondary extension rod 44 that may be used to extend length 22 of rod assembly 20. Primary and secondary extension rods 42, 44 are positioned within support rod 28 at each of its first and second ends 38, 40, with each secondary extension rod 44 also being positioned within one of primary extension rods 42. However, in some embodiments, rod assembly 20 may include primary and secondary extension rods 42, 44 at either first end 38 or second end 40 of support rod 28. Additionally, rod assembly 20 may not include secondary extension rod 44 or may include additional extension rods. In FIG. 1, bag splitting device 10 is the retracted position because primary and secondary extension rods 42, 44 are fully retracted within support rod 28. That is, primary extension rods 42 cannot be retracted any farther into support rod 28, and secondary extension rods 44 cannot be retracted any farther into primary extension rods 42. While FIG. 1 shows that primary and secondary extension rods 42, 44 do not fully fit within support rod 28 in the retracted position, primary and secondary extension rods 42, 44 may be designed to fit fully within support rod 28 in the retracted position in other embodiments.

Primary and secondary extension rods 42, 44 of rod assembly 20 are held in position using four securing devices 46. In the embodiment of bag splitting device 10 shown in FIG. 1, each securing device 46 is a fastener 46 having a handle or knob 48 and a threaded stud 50. However, in various embodiments, securing devices 46 may be in another form such as, for example, retractable pins (not shown) that operate in conjunction with a plurality of pin holes (not shown) on primary and secondary extension rods 42, 44. Two of fasteners 46 extend through openings 52 in first side surface 32 of support rod 28 and push against respective primary extension rods 42 in order to prevent movement of primary extension rods 42 with respect to support rod 28. The other two fasteners 46 extend through openings 54 (shown in FIGS. 3 and 5) on primary extension rods 42 and push against secondary extension rods 44 in order to prevent movement of secondary extension rods 44 with respect to primary extension rods 42. When primary and secondary extension rods 42, 44 are at least mostly retracted within support rod 28, fasteners 46 extending through openings 54 in primary extension rods 42 also extend through notches 56 (shown in FIGS. 3 and 5) at first and second ends 38, 40 of support rod 28 so as to permit primary and secondary extension rods 42, 44 to retract farther within support rod 28. Notches 56 also act as a stop for fasteners 46 extending into primary extension rods 42 so that primary extension rods 42 do not retract too far into support rod 28. As discussed in more detail with respect to FIGS. 3 and 5-6, fasteners 46 may be loosened to allow primary and secondary extension rods 42, 44 to extend out from support rod 28 and retightened such that bag splitting device 10 may be in an extended position.

In addition to housing primary and secondary extension rods 42, 44, support rod 28 of rod assembly 20 provides support for cutting blade 24. In the embodiment of bag splitting device 10 of FIG. 1, cutting blade 24 extends from top surface 30 of support rod 28 such that a height 58 of cutting blade 24 is substantially perpendicular to top surface 30 and a length 60 of cutting blade 24 is substantially parallel to length 22 of rod assembly 20. However, cutting blade 24 may extend from any of top surface 30, first side surface 32, second side surface 34, bottom surface 36 or a combination thereof and may extend from such surfaces 30, 32, 34, 36 at various angles, as desired or required to adjust the performance of bag splitting device 10 for different applications. In addition, while only one cutting blade 24 is shown, bag splitting device 10 may include one or more cutting blades 24 extending from the same or different surfaces 30, 32, 34, 36 of support rod 28. The additional cutting blades 24 may be adapted for different applications.

Cutting blade 24 may be formed integrally with support rod 28 or may be attached to support rod 28. In embodiments in which cutting blade 24 is not integrally formed with support rod 28, cutting blade 24 may be attached to support rod 28 in a semipermanent or permanent manner such as, for example, by welding cutting blade 24 to support rod 28. Cutting blade 24 may also be removably attached to top surface 30 in a manner that allows cutting blade 24 to be easily replaced. As a non-limiting example, cutting blade 24 may be attached to support rod 28 by inserting cutting blade 24 into a slot (not shown) formed in top surface 30 of support rod 28. As another non-limiting example, cutting blade 24 may be removably attached to support rod 28 via a clamp (not shown). As yet another non-limiting example, cutting blade 24 may include a base (not shown) that slides into a bracket (not shown) mounted on or formed integrally with support rod 28.

In the embodiment of bag splitting device 10 of FIG. 1, cutting blade 24 includes a substantially semicircular body 62 and a plurality of teeth or spikes 64 extending therefrom. Each spike 64 includes a tip 66 pointing in an upward direction either perpendicularly or obliquely away from top surface 30 of support rod 28. In FIG. 1, tips 66 of spikes 64 do not come to a sharp point for safety purposes. However, tips 66 may come to a sharp point in other embodiments so that bag splitting device 10 may split open thicker bags or bags constructed of a tougher material.

In addition, cutting blade 24 may be formed in a variety of different configurations. As a non-limiting example, cutting blade 24 may be formed with a substantially rectangular body 62 and spikes 64 extending upward therefrom. As another non-limiting example, cutting blade 24 may be formed without body 62 and with spikes 64 extending directly from support rod 28. Further, while spikes 64 of cutting blade 24 are shown as oriented in different directions such that each tip 66 points in at least a somewhat different direction, one or more spikes 64 may be oriented in substantially the same direction such that each tip 66 points in substantially the same direction. As a non-limiting example, spikes 64 may be arranged on cutting blade 24 such that each tip 66 of spikes 64 points in a purely vertical direction. Additionally, in some embodiments, cutting blade 24 may include only one spike 64 or body 62 may include a smooth cutting edge without spikes 64.

Figure 2A:
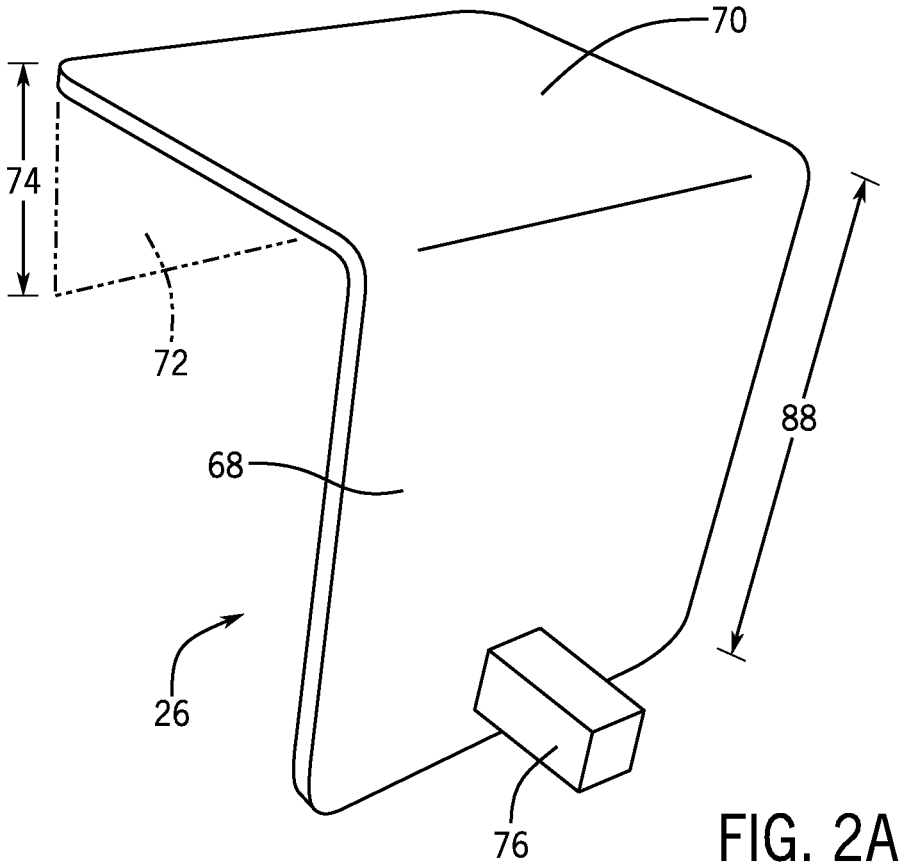
FIGS. 2A-2B are perspective and side views, respectively, of a support bracket useable with the universal bag splitting device of FIG. 1, according to an embodiment of the invention.
Figure 2B:
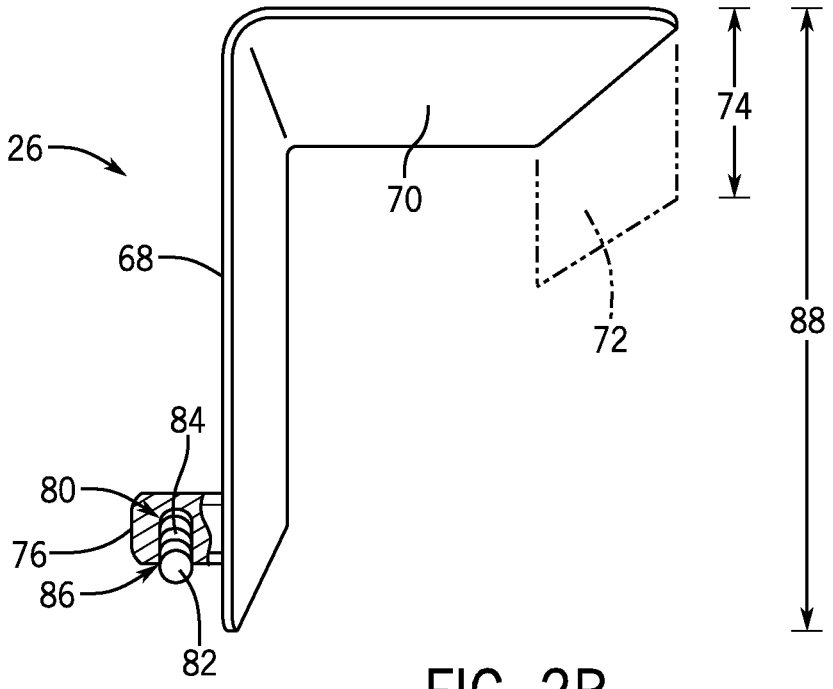

Cutting blade 24 and rod assembly 20 may be used in conjunction with container 12 via support brackets 26 of bag splitting device 10. Support brackets are illustrated in greater detail in FIGS. 2A-2B, which show perspective and side views, respectively, of support brackets 26, according to an embodiment of the invention. Support brackets 26 are L-shaped angle brackets having a first, substantially vertical plate 68 integrally formed with a second, substantially horizontal plate 70 extending from first plate 68 such that first and second plates 68, 70 are substantially perpendicular to each other. However, in some embodiments, first and second plates 68, 70 are separate plates that are connected together using a method such as, for example, welding. In addition, as shown in FIGS. 2A-2B, support brackets 26 may include an optional third, substantially vertical plate 72. A height 74 of third plate 72 may be such that support brackets 26 are J-shaped brackets instead of L-shaped brackets. However, third plates 72 may also be taller such that height 74 causes support brackets 26 to be substantially U-shaped. When support brackets 26 include third plate 72, second plate 70 may be shorter such that support brackets 26 essentially hook over sidewall 14 of container 12 to provide more stability to support brackets 26.

Each support bracket 26 further includes a connector 76 either integrally formed with or connected to first plate 68. Connectors 76 enable a connection between each support bracket 26 and each end 78 of rod assembly 20. In the embodiment of bag splitting device 10 of FIG. 1, each end 78 of rod assembly 20 is located on one of secondary extension rods 44. As shown in FIGS. 2A-2B, each connector 76 is a square drive 76, which is sized to fit within an opening 79 (shown in FIG. 5) at each end 78 of rod assembly 20/secondary extension rods 44. Each square drive 76 includes a ball plunger mechanism 80 (shown in FIG. 2B) including a ball 82 and a spring 84 within a bored cylinder 86. When square drives 76 are inserted into ends 78, each ball 82 is depressed into its corresponding spring 84, with each spring 84 being compressed within bored cylinder 86.

Each square drive 76 is held within rod assembly 20 because spring 84 pushes ball 82 to contact secondary extension rod 44 and the pressure ball 82 exerts on secondary extension rod 44 is enough to maintain the position of each square drive 76 within each secondary extension rod 44. However, in some embodiments, secondary extension rods 44 may include a detent (not shown) that corresponds with ball 82 on square drive 76 and locks square drive 76 into secondary extension rods 44 when ball 82 is engaged therewith. In that case, support brackets 26 and/or secondary extension rods 44 may include a release mechanism (not shown) that would retract and/or push ball 82 out of the detent in secondary extension rods 44 to enable removal of square drive 76 from secondary extension rods 44. In either case, square drive 76 is considered to be a quick change connector that allows support brackets 26 to be quickly inserted and removed from ends 78 of rod assembly 20/secondary extension rods 44. Further, since each support bracket 26 includes square drive 76, support brackets 26 are interchangeable at ends 78.

While support brackets 26 are shown with square drives 76 for making the connection with rod assembly 20, connectors 76 may be in another form and/or may be included on rod assembly 20. As a non-limiting example, rod assembly 20 could include a quick change chuck (not shown) that engages corresponding connectors on support brackets 26 via a slidable locking mechanism (not shown). In addition, while the connection between rod assembly 20 and support brackets 26 is preferably in the form of a quick change connection, the connection may be a made via another type of removable connection. As a non-limiting example, the connection may be made via threaded connectors (not shown) on rod assembly 20 and support brackets 26. As another non-limiting example, support brackets 26 may be connected to rod assembly 20 using one or more fasteners (not shown).

Referring again to FIG. 1, support brackets 26 are configured such that each second plate 70 rests on top of sidewall 14 of container 12 and each first plate 68 extends down into container 12 in order to position rod assembly 20 below upper edge 16 of sidewall 14 of container 12. Preferably, first plates 68 have a height 88 that allows the highest point of cutting blade 24 to be positioned underneath or at least level with second plates 70. In this manner, cutting blade 24 can be recessed with respect to second plates 70 of support brackets 26 and/or upper edge 16 of sidewall 14 of container 12.

It is desirable to recess cutting blade 24 using support brackets 26 for both safety and operational purposes. Initially, those using bag splitting device 10 in container 12 will be less likely to injure themselves on cutting blade 24 if cutting blade 24 is recessed within container 12, as sidewall 14 will partially block access to cutting blade 24. In addition, the farther cutting blade 24 is recessed within container 12, the less likely materials from bags being split open by cutting blade 24 will spill outside of container 12. However, in some embodiments, first plates 68 may be designed with a shorter height 88 that allows cutting blade 24 to extend above second plates 70 so that bag splitting device 10 takes up less volume within container 12. Further, in various embodiments, rather than, or in addition to shortening height 88 of first plates 68, connector 76 may be moved higher on first plates 68 such that it is closer to second plate 70 and such that rod assembly 20 is positioned near upper edge 16 of sidewall 14 of container 12.

Regardless of where exactly rod assembly 20 is positioned with respect to support brackets 26, bag splitting device 10 may be used to empty bags of materials directly into container 12 when support brackets 26 are engaged with sidewall 14 of container 12. Initially, a bag of materials, such as, for example, seed, fertilizer, salt, snow melt, joint compound, concrete mix, or mortar mix, may be lowered onto cutting blade 24 such that spikes 64 of cutting blade 24 puncture/split open the bag. Once the bag is split open, the materials within the bag will empty into container 12 through opening 18. Then, since support brackets 26 are not mounted onto sidewall 14 of container 12, bag splitting device 10 may be easily removed from container 12 in order to access the materials emptied into container 12. The materials may then be used within container 12 or may be easily transferred to another container or machine for use therein.

While FIG. 1 only illustrates bag splitting device 10 as being used with container 12 having only one, substantially circular sidewall 14, bag splitting device 10 may be used with containers of various shapes, as long as the containers include at least one sidewall that can bear the weight of bag splitting device 10 when engaged with support brackets 26. As a non-limiting example, bag splitting device 10 may be used with a substantially square or rectangular container having four sidewalls, with support brackets 26 resting on opposite sidewalls of the container. As another non-limiting example, bag splitting device 10 may be used with a wheel barrow, with support brackets 26 resting on left and right sidewalls of the wheel barrow from the perspective of one standing behind or in front of the wheel barrow.

In addition, bag splitting device 10 may be used outside of a container. Initially, bag splitting device 10 may be positioned above a container, with support brackets 26 positioned on other apparatus. As a non-limiting example, support brackets 26 may be positioned on tables, shelves, or other similar structures space apart from each other, with a container sitting underneath bag splitting device 10 to catch materials from bags split open by cutting blade 24. Furthermore, bag splitting device 10 may be used directly in machines without the need to transfer materials from a container. As a non-limiting example, bag splitting device 10 may be used with seed, fertilizer, or salt spreaders.

Figure 3:
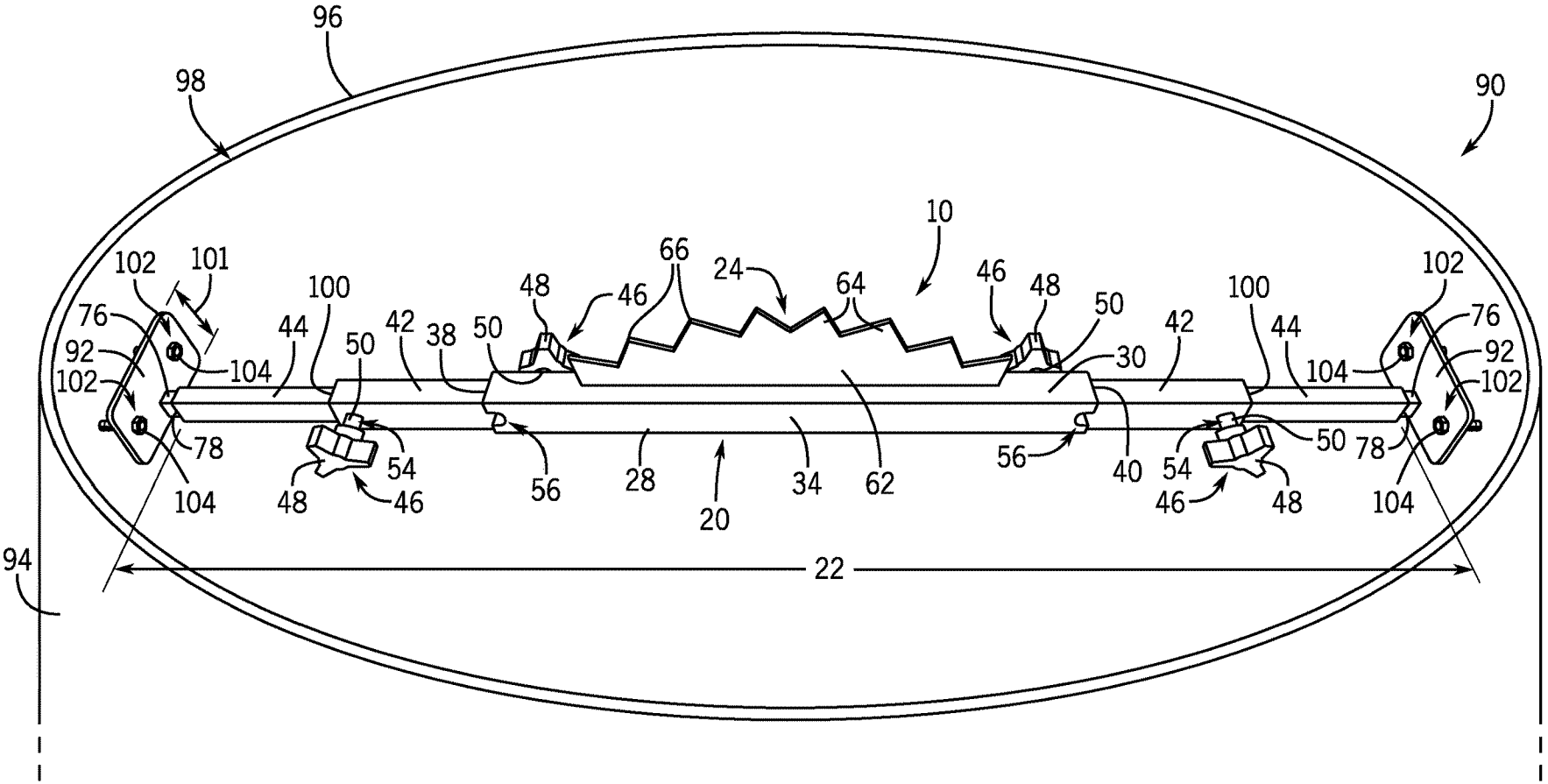
FIG. 3 is a perspective view of the universal bag splitting device of FIG. 1 mounted within a container, according to an embodiment of the invention.
Figure 4:
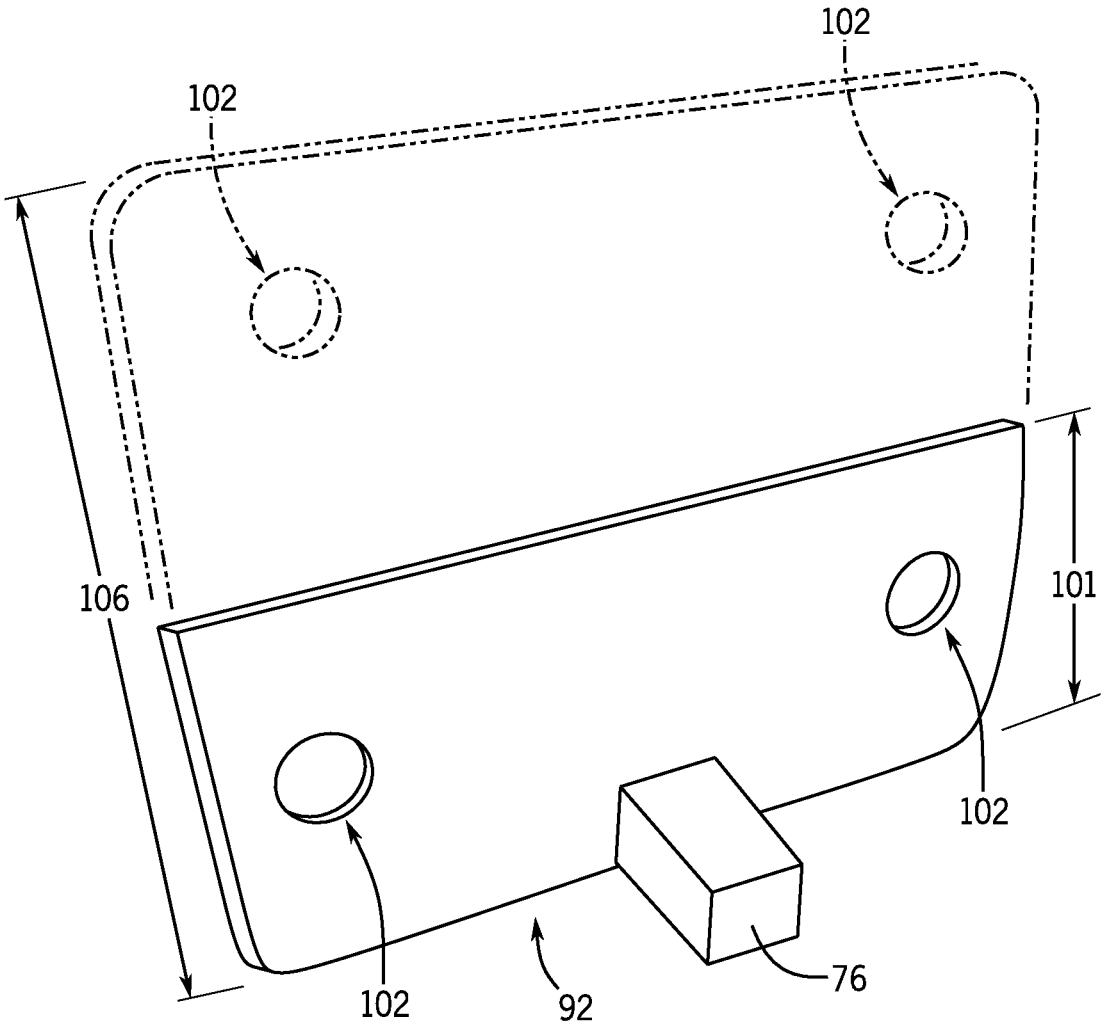
FIG. 4 is a perspective view of a mounting bracket useable with the universal bag splitting device of FIG. 1, according to an embodiment of the invention.

Referring now to FIGS. 3-4, FIG. 3 shows a perspective view of bag splitting device 10 of FIG. 1 mounted within a container 90 using mounting brackets 92, and FIG. 4 shows a perspective view of one mounting bracket 92, according to an embodiment of the invention. Initially, FIG. 3 illustrates how bag splitting device 10 may be used with containers of various sizes by adjusting variable length 22 of rod assembly 20 using first and/or secondary extension rods 42, 44. Container 90 of FIG. 3 is similar to container 10 of FIG. 1 in that container 90 includes a substantially circular sidewall 94 having an upper edge 96 forming an opening 98. However, container 90 is larger than container 10 of FIG. 1. As a non-limiting example, container 90 may be a water softener brine tank.

When bag splitting device 10 is in the retracted position, rod assembly 20 is not long enough to reach across opening 98 of container 90. Therefore, bag splitting device 10 is adjusted into an expanded position by increasing variable length 22 of rod assembly 20 and secured in position using fasteners 46. In the expanded position shown in FIG. 2, primary and secondary extension rods 42, 44 extend out from first and second ends 38, 40 of support rod 28 of rod assembly 20. That is, primary extension rods 42 extend out of first and second ends 38, 40 of support rod 28, and secondary extension rods 44 extend out of ends 100 of primary extension rods 44.

Rod assembly 20 is shown in FIG. 3 with primary and secondary extension rods 42, 44 extending an approximately equal distance from support rod 28 such that support rod 28 is centered with respect to ends 78 of rod assembly 20/secondary extension rods 44. However, support rod 28 does not necessarily have to be centered with respect to ends 78. Length 22 of rod assembly 20 may also be adjusted by retracting or extending primary and secondary extension rods 42, 44 in an uneven manner such as, for example, by extending or retracting primary extension rod 42 and/or secondary extension rod 44 at only first end 38 or second end 40 of support rod 28. The extension and retraction of primary and secondary extension rods 42, 44 will be explained in greater detail below with respect to FIGS. 5-6.

In addition to the above, FIG. 3 illustrates how bag splitting device 10 may not only be removably supported on a container, as shown in FIG. 1, but also mounted within a container. Bag splitting device 10 is not limited to use with support brackets such as, for example, support brackets 26 shown in FIGS. 1-2B. Bag splitting device 10 may be used with mounting brackets such as, for example, mounting brackets 92 shown FIGS. 3-4. Mounting brackets 92 have a height 101 and include mounting holes 102 for fasteners 104 to mount bag splitting device 10 within container 90. While mounting brackets 92 are shown with two mounting holes 102 in FIG. 3, mounting brackets 92 may include only one mounting hole 102 or additional mounting holes 102 in various embodiments. Further, in some embodiments, mounting brackets 92 may be larger in width and/or height. FIG. 4 illustrates a non-limiting example of a larger mounting bracket 92 that may optionally have an increased height 106 and/or two additional mounting holes 102.

Furthermore, mounting brackets 92 are not limited to use in containers and may be used to mount bag splitting device 10 between any combination of two additional types of applicable structures such as, for example, walls, cabinets, tables, and shelves. Mounting brackets 92 may be mounted to the different types of structures using various types of fasteners such as, for example, bolts and screws. In the embodiment of bag splitting device 10 of FIG. 3, fasteners 104 used in mounting brackets 92 are in the form of bolts 104 extending through mounting holes 102 in mounting brackets 92 and mounting holes (not shown) in sidewall 94 of container 90. Bolts 104 may be secured in position by tightening nuts (not shown) onto sidewall 94 outside of container 90. Washers (not shown) and/or a bolt tie plate (not shown) may be used in between the nuts and sidewall 94. Sidewall 94 of container 90 may include pre-drilled mounting holes. However, mounting holes may need to be formed in sidewall 94 prior to mounting bag splitting device 10 within container 90.

In FIG. 3, mounting brackets 92 of bag splitting device 10 are mounted in container 90 below upper edge 96 such that the highest point of cutting blade 24 is underneath or at least level with upper edge 96. In this manner, cutting blade 24 may be recessed with respect to upper edge 96. Mounting brackets 92 may also be designed such that height 106 automatically recesses cutting blade 24 in a similar manner to first plates 68 of support brackets 26 of FIGS. 1-2B. It is desirable to recess cutting blade 24 for similar reasons discussed above with respect to support brackets 26. Initially, users of bag splitting device 10 are less likely be injured on cutting blade 24 if cutting blade 24 is recessed in container 90, as sidewall 94 of container 90 will partially block access to bag splitting device 10. Further, the lower cutting blade 24 is positioned within container 90, the less likely materials from bags being split open by cutting blade 24 will spill outside of container 90. Additionally, if cutting blade 24 is recessed in container 90 rather than extending through opening 98, a container cover (not shown) may be placed over opening 98. However, some types of container covers may still be used with container 90 is cutting blade 24 extends through opening 98.

As shown in FIG. 4, in addition to mounting holes 102, each mounting bracket 92 includes the same connector 76 as support brackets 26. This allows each mounting bracket 92 to connect to ends 78 of rod assembly 20. Connector 76 is typically, but not necessarily, centered between mounting holes 102 on mounting bracket 92, as shown in FIGS. 3-4, to provide stability in mounting bag splitting device 10. However, connector 76 may be positioned on mounting bracket 92 anywhere along height 101 or height 106, depending on the desired position for rod assembly 20 and/or cutting blade 24 with respect to mounting brackets 92. As a non-limiting example, connector 76 may be centered vertically along height 101 or height 106. As another non-limiting example, connector 76 may be positioned near or at the top of height 101 or height 106 as opposed to near or at the bottom or height 101 or height 106, as shown in FIGS. 3-4.

The removable connection to rod assembly 20 via connector 76 provides the benefit of being able to individually install mounting brackets 92 in container 90 before attaching them to rod assembly 20. After mounting brackets 92 are installed using fasteners 104, length 22 of rod assembly 20 may be expanded to reach mounting brackets 92 in order to connect ends 78 of rod assembly 20 to mounting brackets 92. It may be much easier to mount bag splitting device 10 this manner because the installer does not need to hold or have an assistant hold rod assembly 20 during installation.

In addition to the above-noted installation benefit, connector 76 provides the benefit of making support brackets 26 and mounting brackets 92 interchangeable at ends 78 of rod assembly 20. This bracket interchangeability makes bag splitting device 10 quickly adaptable to a variety of different configurations including a removably supported configuration, such that shown in FIG. 1, and a mounted configuration such as that shown in FIG. 3. Bag splitting device 10 may additionally be adapted to a combination or hybrid of the mounted and supported configurations in which one support bracket 26 and one mounting bracket 92 are used. The hybrid configuration is referred to as a mounted and supported configuration. As a non-limiting example of the mounted and supported configuration, a container may have an irregular shape that would make it advantageous to use mounting bracket 92 on one side of bag splitting device 10 and support bracket 26 on the other side. As another non-limiting example, one may wish to mount one side of bag splitting device 10 to a wall using mounting bracket 92 and have the other side of bag splitting device 10 rest on another structure, such as, for example, a container, cabinet, table, or shelf, to which mounting is not desirable, practical, and/or possible.

Figure 5:
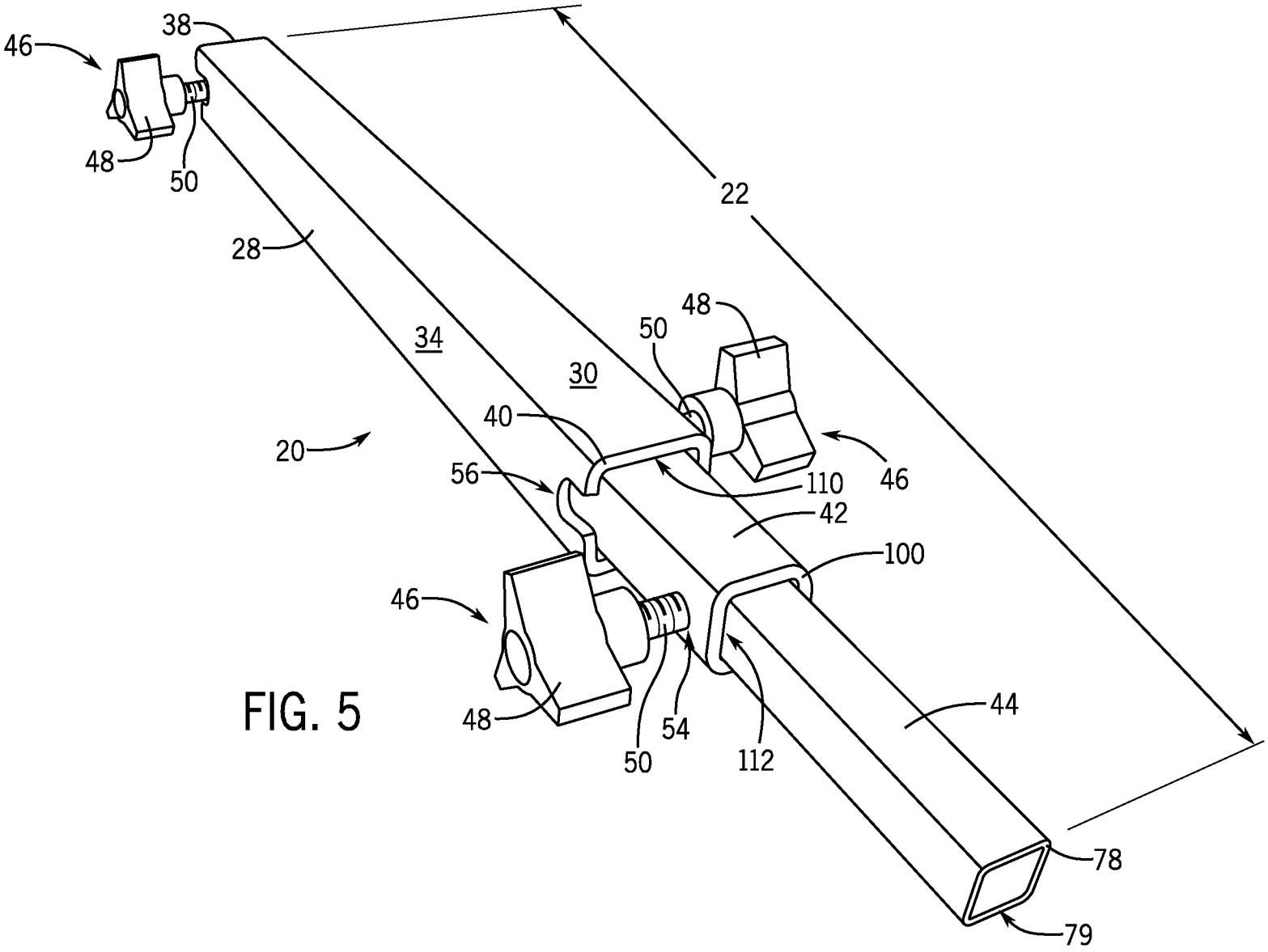
FIG. 5 is a perspective view of a rod assembly of the universal bag splitting device of FIG. 1, according to an embodiment of the invention.
Figure 6:
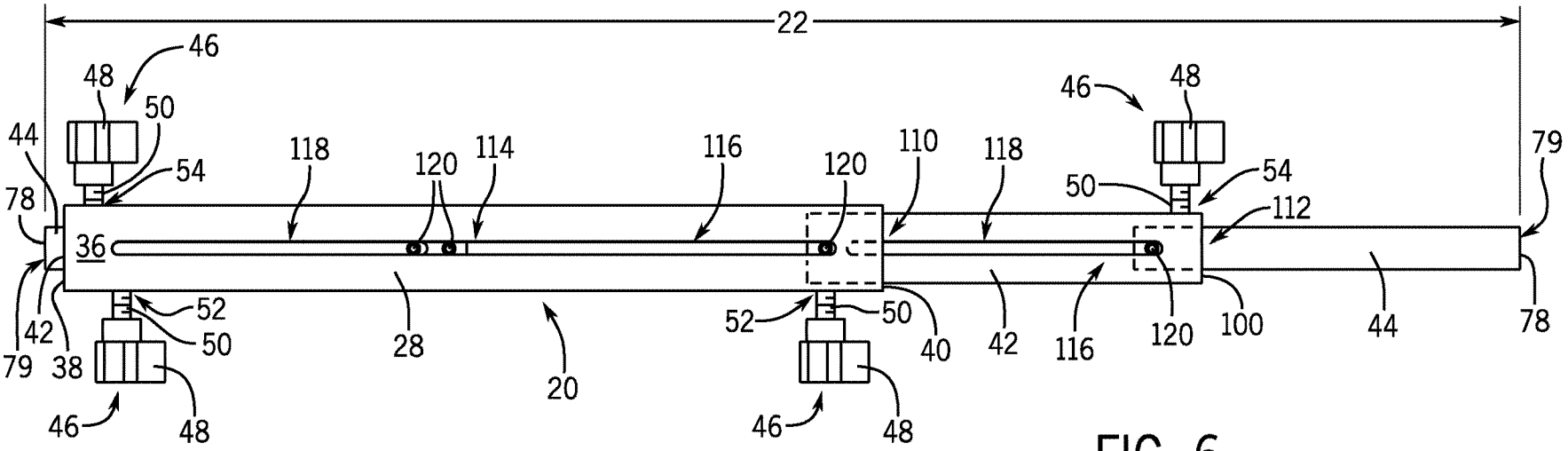
FIG. 6 is a bottom view of the rod assembly of FIG. 5, according to an embodiment of the invention.

Referring now to FIGS. 5-6, the expansion and retraction of rod assembly 20 will be discussed further. FIG. 5 illustrates a perspective view of rod assembly 20 of bag splitting device 10, according to an embodiment of the invention. FIG. 6 illustrates a bottom view of rod assembly 20 of bag splitting device 10, according to an embodiment of the invention. In FIGS. 5-6, rod assembly 20 is retracted at end 78 near first end 38 of support rod 28 and is expanded at end 78 near second end 40 of support rod 28.

In order to expand rod assembly 20 from the retracted position to the expanded position at the expanded end 78 of rod assembly 20 in FIGS. 5-6, fasteners 46 must first be loosened. Fastener 46 extending through opening 52 on first side surface 32 (shown in FIG. 1) of support rod 28 is associated with primary extension rod 42, and fastener 46 extending through opening 54 on primary extension rod 42 is associated with secondary extension rod 44. Once their corresponding fasteners 46 are loosened, primary extension rod 42 may extend out of second end 40 of support rod 28 through an opening 110, and secondary extension rod 44 may extend out of end 100 of primary extension rod 42 through an opening 112. After primary and second extension rods 42, 44 are in the desired position, fasteners 46 must then be retightened to hold primary extension rod 42 in position with respect to support rod 28 and to hold secondary extension rod 44 in position with respect to primary extension rod 42.

Both ends 78 of rod assembly 20 may be extended in this manner with or without brackets connected to rod assembly 20 at ends 78 of rod assembly 20 via opening 79. Regardless of whether one or both ends 78 of rod assembly 20 are extended, the end result is that length 22 of rod assembly 20 is increased. Rod assembly 20 may be increased to any length 22 between the retracted length 22 shown in FIG. 1 and a maximum length 22 where primary and secondary extension rods 42, 44 are fully extended. In order to retract primary and secondary extension rods 42, 44 for storage or for use in a different application, one must simply loosen the relevant fasteners 46, slide the extended primary and/or secondary extension rods 42, 44 back into support rod 28 and/or its corresponding primary extension rod 42, and retighten fasteners 46.

Referring now to FIG. 6, primary and secondary extension rods 42, 44 of rod assembly 20 may extend and retract via a telescoping system 114. Telescoping system 114 includes a slot 116 formed in bottom surface 36 of support rod 28, slots 118 formed primary extension rods 42, and a plurality of pins 120 extending from each primary and secondary extension rods 42. Pins 120 on primary extension rods 42 extend into slot 116 of support rod 28, and pins 120 on secondary extension rods 44 extend into slots 118 on secondary extension rods 44. Slots 116, 118 and pins 120 operate together such that primary extension rods 42 are slidably connected to support rod 28 and secondary extension rods 44 are slidably connected to primary extension rods 42.

Slots 116, 118 and pins 120 allow primary and secondary extension rods 42, 44 to extend and retract with more stability. Also, slots 116, 118 and pins 120 prevent primary and secondary extension rods 42, 44 from being removed from rod assembly 20 at full extension. That is, when primary extension rods 42 are being extended through openings 110 at first and second ends 38, 40 of support rod 28, primary extension rods 42 cannot fall out of support rod 28 because pins 120 on primary extension rods 42 are bound by slot 116 in support rod 28. In a similar manner, pins 120 on secondary extension rods 44 are bound by slots 118 on primary extension rods 42. Thus, when a user is extending length 22 of rod assembly 20 to fit a particular application, a user will not need to worry about accidently pulling primary and secondary extension rods 42, 44 out of rod assembly 20 and then having to reinsert them to continue use of bag splitting device 10.

In some embodiments, pins 120 are retractable. In that case, pins 120 may be pushed through their respective slots 116, 118 and into their respective primary and secondary extension rods 42, 44 so that primary and secondary extension rods 42, 44 may be removed from rod assembly 20. As such, primary and secondary extension rods 42, 44 of rod assembly 20 may be more easily replaced or modified if necessary.

Beneficially, embodiments of the invention thus provide a universal bag splitting device that may be easily modified to fit a variety of different applications. The bag splitting device includes a rod assembly having extension rods that may be extended and retracted with respect to a support rod. The extension rods may be used to adjust a length of the rod assembly to fit differently sized areas in containers, machines, and other structures. In addition, the bag splitting device includes a plurality of interchangeable brackets that are connectable to the rod assembly and may be used to mount the bag spitting device, support the bag spitting device, or a combination thereof. The bag splitting device further includes a cutting blade extending from the rod assembly that may be used to split open bags of materials such that the materials are conveniently emptied directly into containers and machines in which the bag splitting device is mounted or on which the bag splitting device is supported.

According to one embodiment of the present invention, a universal bag splitting device includes a rod assembly with an adjustable length, a cutting blade attached to a surface of the rod assembly, and a pair of interchangeable brackets connectable to first and second ends of the rod assembly. The pair of interchangeable brackets are configured to maintain a position of the rod assembly when the universal bag splitting device is in use.

According to another embodiment of the present invention, a universal bag splitting apparatus includes a rod assembly having a first end, a second end, a support rod, and a first primary extension rod that is adjustable with respect to the support rod at the first end of the rod assembly to modify a length of the rod assembly. The universal bag splitting apparatus further includes a cutting blade attached to the support rod of the rod assembly, a first bracket connectable to at least the first end of the rod assembly, and a second bracket connectable to at least the second end of the rod assembly. The first and second brackets are configured to sustain a position of the rod assembly in at least one configuration selected from the group of a mounted configuration, a supported configuration, and a mounted and supported configuration.

According to yet another embodiment of the present invention, a kit for a universal bag splitting assembly includes an adjustable rod assembly. The adjustable rod assembly includes a support rod with a first end and a second end. The adjustable rod assembly also includes one or more extension rods positioned at each of the first end of the support rod and the second end of the support rod for adjusting a length of the rod assembly. Each extension rod is moveable with respect to the support rod, another extension rod of the one or more extension rods, or a combination thereof. The universal bag splitting assembly additionally includes a cutting blade attachable to a surface of the support rod between the first and second ends of the support rod and a plurality of interchangeable brackets that are attachable to the rod assembly and capable of sustaining a position of the rod assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A kit for a universal bag splitting assembly, the kit comprising:

an adjustable rod assembly comprising:

a support rod having a first end, a second end and a slot formed therein;

extension rods positioned at each of the first end of the support rod and the second end of the support rod for adjusting a length of the rod assembly, each extension rod being moveable with respect to the support rod, another extension rod of the extension rods, or a combination thereof;

a cutting blade attachable to a surface of the support rod between the first and second ends of the support rod; and a plurality of interchangeable brackets that are attachable to the rod assembly and capable of sustaining a position of the rod assembly;

wherein the extension rods comprise:

a first primary extension rod that is slidably adjustable with respect to the first end of the support rod and has a slot formed therein;

a second primary extension rod that is slidably adjustable with respect to the second end of the support rod and has a slot formed therein;

a first secondary extension rod that is slidably adjustable with respect to the first primary extension rod; and, a second secondary extension rod that is slidably adjustable with respect to the second primary extension rod;

wherein each of the first and second primary extension rods each include a pin that slides within the slot of the support rod to prevent the first and second primary extension rods from being removed from the support rod;

wherein the first secondary extension rod includes a pin that slides within the slot of the first primary extension rod to prevent the first secondary extension rod from being removed from the first primary extension rod; and, wherein the second secondary extension rod includes a pin that slides within the slot of the second primary extension rod to prevent the second secondary extension rod from being removed from the second primary extension rod.

* * * * *